US011760565B2

(12) United States Patent
Collins et al.

(10) Patent No.: US 11,760,565 B2
(45) Date of Patent: Sep. 19, 2023

(54) METHODS AND SYSTEMS FOR REMOTE OPENING AND MONITORING OF AN ACCESS HATCH

(71) Applicant: Conspec Controls, Inc., Charleroi, PA (US)

(72) Inventors: Robert E. Collins, Pittsburgh, PA (US); Paul Douglas Boyce, Fairmont, WV (US)

(73) Assignee: Conspec Controls, Inc., Charleroi, PA (US)

( * ) Notice: Subject to any disclaimer, the term of this patent is extended or adjusted under 35 U.S.C. 154(b) by 651 days.

(21) Appl. No.: 16/769,676

(22) PCT Filed: Nov. 26, 2019

(86) PCT No.: PCT/US2019/063169
§ 371 (c)(1),
(2) Date: Jun. 4, 2020

(87) PCT Pub. No.: WO2020/112717
PCT Pub. Date: Jun. 4, 2020

(65) Prior Publication Data

US 2021/0362944 A1 Nov. 25, 2021

Related U.S. Application Data

(60) Provisional application No. 62/771,425, filed on Nov. 26, 2018.

(51) Int. Cl.
*B65D 90/10* (2006.01)
*B65D 90/51* (2019.01)
*E05D 13/00* (2006.01)

(52) U.S. Cl.
CPC ..... *B65D 90/10* (2013.01); *B65D 90/51* (2019.02); *E05D 13/14* (2013.01);
(Continued)

(58) Field of Classification Search
CPC .... B65D 90/623; B65D 90/626; B65D 90/10; B65D 90/51; E05F 11/04; E05F 11/12;
(Continued)

(56) References Cited

U.S. PATENT DOCUMENTS 352,818 A * 11/1886 Harbort ..... E05F 15/627 119/302
706,829 A * 8/1902 Johnson ..... E05F 11/16 49/344

(Continued)

FOREIGN PATENT DOCUMENTS

WO 2017099618 A1 6/2017

OTHER PUBLICATIONS

ISR/WO of related PCT/US2019/063169 with mail date of Mar. 16, 2020.

(Continued)

*Primary Examiner* — Justin B Rephann
(74) *Attorney, Agent, or Firm* — Vorys, Sater, Seymour and Pease LLP

(57) ABSTRACT

A system for remotely opening an access hatch of storage tank includes an elongate arm having a proximal end configured to be operatively coupled to a lid of the access hatch and a distal end extendable past an outer perimeter of the storage tank, and a pull cable attached to the arm at the distal end and being extendable toward a ground surrounding the storage tank. Pulling on the pull cable releases a latch that secures the lid to a base of the access hatch and allows the lid to pivot from a closed position to an open position.

18 Claims, 5 Drawing Sheets

(52) U.S. Cl.
CPC .. *B65D 2590/0083* (2013.01); *B65D 2590/22* (2013.01); *E05Y 2900/604* (2013.01)

(58) Field of Classification Search
CPC ... E05F 11/627; E05D 13/14; E05Y 2900/604
See application file for complete search history.

(56) References Cited

U.S. PATENT DOCUMENTS 1,494,290 A * 5/1924 Ruhmann ..... F23J 13/08 454/7
1,606,621 A * 11/1926 Fischer ..... E05F 11/04 49/357
2,495,505 A * 1/1950 Bella ..... B65F 1/12 220/628
3,064,931 A * 11/1962 Rowe ..... B65F 1/1421 248/154
3,733,750 A * 5/1973 Hege ..... E05F 1/1075 52/192
3,961,660 A * 6/1976 Vinci ..... E05F 11/10 160/188
4,120,341 A 10/1978 Doering
4,208,839 A * 6/1980 Candy, Sr. ..... B65D 90/10 49/357
4,327,522 A 5/1982 Meadows
4,598,496 A * 7/1986 Van Daele ..... B65D 90/623 49/357
4,625,888 A * 12/1986 Thompson ..... B65D 90/623 49/404
4,744,183 A * 5/1988 Kruger ..... B65D 90/623 220/264
4,747,244 A * 5/1988 Christianson ..... B65D 90/10 220/264
5,218,784 A * 6/1993 Pollock ..... B65D 90/10 52/192
5,570,547 A * 11/1996 Webb ..... B65D 88/08 52/192
5,839,597 A * 11/1998 Marttila ..... B65D 90/10 220/264
6,561,373 B1 * 5/2003 Chapin ..... B65D 90/10 49/360
6,792,716 B1 9/2004 Luster
7,093,733 B2 * 8/2006 Nishimura ..... B01J 3/03 220/829
8,196,362 B1 * 6/2012 Ratts ..... E05F 11/12 52/192
8,375,637 B2 * 2/2013 Zazula ..... E05F 11/04 49/357
9,764,893 B1 9/2017 Westmoreland, III
9,919,867 B1 * 3/2018 Poncsak ..... B65D 90/623
9,976,337 B2 * 5/2018 Kirchhoff ..... E05F 15/652
10,161,176 B1 * 12/2018 Schmidt ..... E05F 15/616
2017/0081905 A1 * 3/2017 Kirchhoff ..... E05F 15/622

OTHER PUBLICATIONS

First office action for CN2019800773405—with translation of cover pages.

* cited by examiner

METHODS AND SYSTEMS FOR REMOTE OPENING AND MONITORING OF AN ACCESS HATCH

BACKGROUND

In the oil and gas industry, various types of storage tanks are used during hydrocarbon production processes to contain liquids and gases, such as oil, crude oil, raw natural gas, refined products, drip gas, etc. The liquids and gases contained within oilfield storage tanks often emit (produce) volatile organic compounds (VOCs), and the storage tanks are designed to contain the liquids and gases within the interior, while simultaneously preventing harmful VOCs from being vented into the surrounding atmosphere. These storage tanks can be constructed of virtually any industrial material, such as metal (e.g., stainless steel), plastics, or composite materials (e.g., fiberglass).

In most storage tank designs, a manhole or access hatch is provided on the roof of the storage tank to enable tank operators (workers) to access the interior of the tank. Commonly known in the oil and gas industry as "thief hatches," these access hatches enable tank operators to visually inspect and gauge the contents of the storage tank, as well as obtain samples of the fluids stored therein. Sampling the fluids within a storage tank typically entails the tank operator manually opening the access hatch on the roof, introducing collection and measurement tools through the access hatch and into the tank, and subsequently retrieving the tools containing a fluid sample.

Opening storage tank access hatches can be hazardous to workers since this allows accumulated VOCs and other toxic vapors or gases to rapidly escape through the access hatch to the surrounding environment. This exposes workers in the same vicinity to hazardous conditions, such as elevated concentrations of hydrocarbon gas and vapor, an oxygen-deficient atmosphere, and the potential for combustion (fire) and/or explosions. Loss of consciousness and even death have been reported as a result of VOCs escaping through opened access hatches. The National Institute for Occupational Safety and Health (NIOSH) and the Occupational Safety and Health Administration (OSHA), for instance, have identified nine worker fatalities that occurred while workers manually gauged or sampled production tanks from 2010-2014. Exposure to VOCs and other toxic gases and vapors and/or oxygen-deficient atmospheres are believed to be the primary or contributory factors to the workers' deaths.

Aside from the use of better personal protective equipment and more effective education on the risks associated with manual access hatch manipulation, the only methods currently used to reduce worker exposure to VOCs released via access hatches are methods of remotely monitoring the contents of the oilfield storage tank. Remote methods, however, do not address worker safety when visual inspection, sampling, and maintenance are required.

In addition to the risk to workers' lives, the Environmental Protection Agency (EPA) has identified access hatches as a source of unchecked release of VOCs into the atmosphere. Unchecked VOC release can occur in a variety of ways. First, tank operators may inadvertently leave the access hatch open following fluid sampling. Second, tank operators might shut the access hatch, but fail to securely latch the access hatch in the closed position. Generally, access hatches are relatively lightweight and will not substantially reduce the flow of VOCs into the atmosphere unless the lid is securely latched to its base. Poor maintenance practices and standards for access hatches are also a major contributing factor to VOC leakage.

Solutions to the foregoing issues common to current oilfield storage tank designs is desired to both improve worker safety and remedy unchecked release of VOCs into the atmosphere.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to storage tanks used in the oil and gas industry and, more particularly, to systems for remotely opening a storage tank access hatch that improves worker safety during inspecting and sampling fluids.

As used herein, the term "off-gas," "off-gases," or any variation thereof refers to gases and/or vapors that are released into the surrounding atmosphere upon opening an access hatch of a storage tank. Off-gases can be especially dangerous to the health and safety of tank operators or workers. One form of off-gas is volatile organic compounds (VOCs), which comprise dissolved hydrocarbon gases released from petroleum hydrocarbons. Example VOCs include, but are not limited to, methane, ethane, propane, butane, hexane, benzene, and xylene. Other types of off-gases can be toxic or harmful gases and/or vapors and can include, but are not limited to, hydrogen sulfide, nitrogen, carbon dioxide, isobutane, isopentane, n-pentane, and heptanes plus.

The present disclosure provides systems and methods for improving worker safety during inspection and sampling from access hatches on oilfield tanks, natural gas tanks, production tanks, and flow back tanks, through remote opening of the access hatch and monitoring and reporting the presence of escaping off-gases from the access hatch. Monitoring and reporting will improve worker safety by identifying when off-gas levels are below a safety threshold so that a worker may climb to the access hatch for inspection and sampling both after opening and during storage. Monitoring and reporting will also improve unchecked release of off-gases into the atmosphere, as leaks will be more readily detected and reported so that they may be rectified.

In addition to being able to remotely open the access hatch from the ground, the systems described herein also include a monitoring system that monitors the environment surrounding the access hatch and notifies tank operators when it is safe to approach the access hatch for inspecting and sampling of the liquid inside. Thus, the present disclosure also provides mechanisms and methods for monitoring the area around the access hatch for volatile gases that may be toxic, in order to warn workers to stay away from the area near the access hatch, or to indicate a leak.

Figure 1:
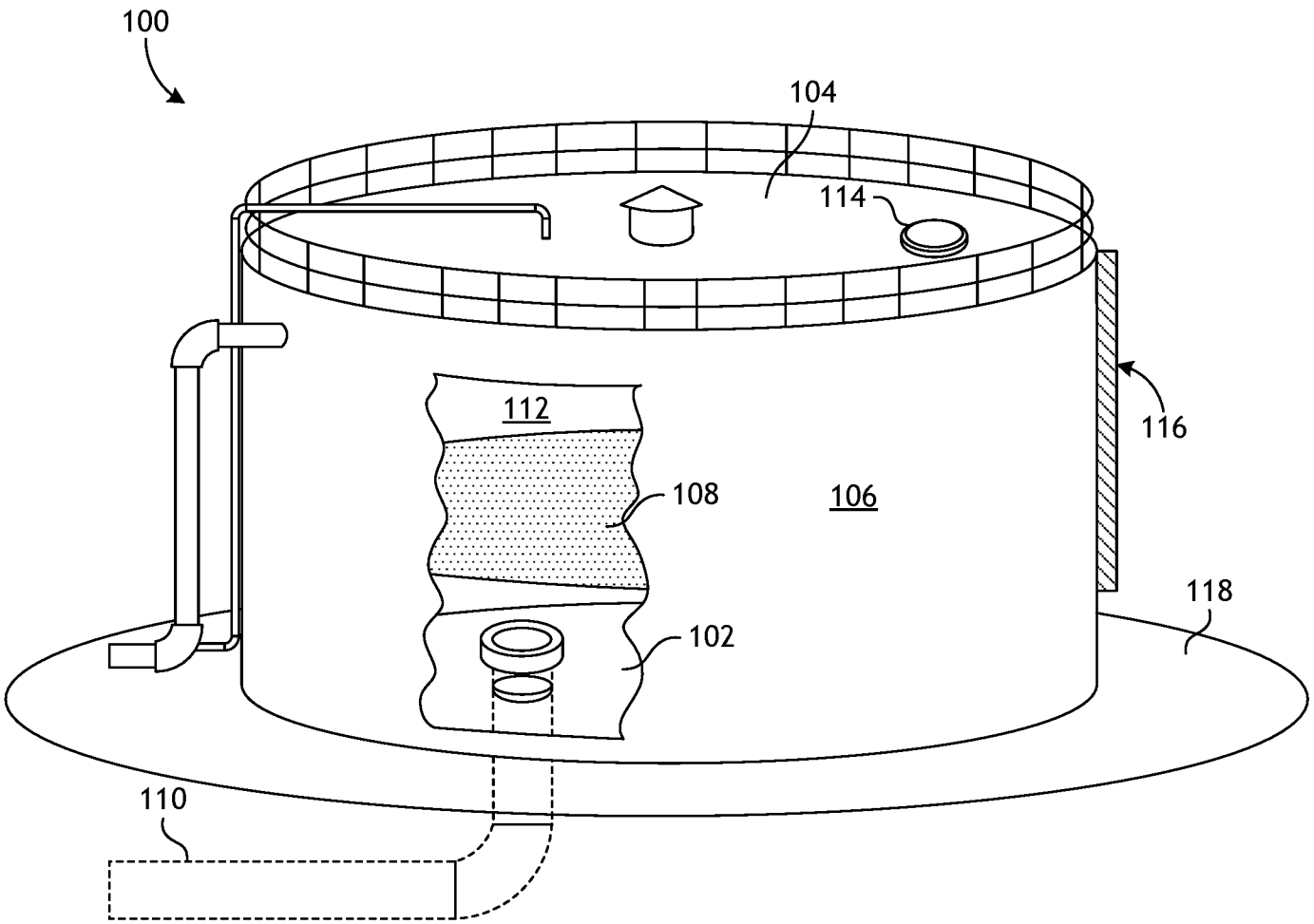
FIG. 1 PRIOR ART
FIG. 1 is a prior art storage tank that may incorporate the principles of the present disclosure.

FIG. 1 is a prior art storage tank 100 that may incorporate the principles of the present disclosure. The storage tank 100, alternately referred to as a "condensate tank" or a "stock tank", may be configured to contain various types of fluids (e.g., liquids and/or gases) related to the oil and gas industry. Common fluids that might be contained within the storage tank 100 include, but are not limited to, oil, crude oil, raw natural gas, refined products, drip gas, cycled concentrations of brine water, other well liquids and chemicals, or any combination thereof.

As illustrated, the storage tank 100 includes a floor 102, a roof 104, and an exterior shell or sidewall 106 extending between the floor 102 and the roof 104. In some examples, as depicted, the sidewall 106 may comprise a continuous, curved structural member that forms a circular or oval wall for the storage tank 100. In other applications, however, the geometric shape of the storage tank 100 may be polygonal (e.g., square, rectangular, etc.). The floor 102, the roof 104, and the sidewall 106 are all suitably connected, sealed, and otherwise constructed to contain liquids and gases within the interior of the storage tank 100.

In the illustrated example, a liquid 108 is contained within the interior of the storage tank 100 and may be fed into the interior via one or more pipes 110. A gas 112 may also be present within the interior above the liquid 108 and, in some cases, may originate from the liquid 108 as a gaseous discharge or emission. In some applications, the gas 112 includes accumulated off-gases emitted from the liquid 108. The storage tank 100 operates, in part, to prevent the off-gases from being inadvertently released into the surrounding environment.

The storage tank 100 also includes an access hatch 114 provided on the roof 104. The access hatch 114, alternately referred to in the industry as a "thief" hatch, is accessible by a tank operator (worker) via a ladder 116 coupled to the sidewall 106. While only one access hatch 114 is depicted in FIG. 1, the storage tank 100 may include more than one access hatch 114, without departing from the scope of the disclosure. The access hatch 114 provides an access point for a worker to visually inspect the contents of the storage tank 100 and obtain samples of the liquid 108 as needed. The act of obtaining a sample of the fluid 108 via the access hatch 114 is sometimes referred to as "thieving". After ascending the ladder 116 and locating the access hatch 114 on the roof 104, the worker will typically manually open the access hatch 114, following which one or more collection and/or measurement tools may be manually introduced into the interior of the storage tank 100 via the open access hatch 114.

With conventional storage tanks, manually opening the access hatch 114 while on the roof 104 can be dangerous for the tank operator (worker) and potentially result in loss of consciousness or even death. More specifically, opening the access hatch 114 allows accumulated off-gases in the gas phase 110 to escape into the surrounding environment via the access hatch 114, which could be inhaled and otherwise ingested (absorbed) by the tank operator. The escaping off-gases may also create an oxygen-deficient atmosphere, or potentially combust or explode, and thereby further put the health and safety of the tank operator at risk.

According to embodiments of the present disclosure, the access hatch 114 may include or otherwise be retrofitted with a system for remotely opening the access hatch 114, which places the worker at a safe distance from any off-gases escaping from the access hatch 114. As described herein, the system includes a series of pulleys and counterweights that allow a tank operator (worker) to open the access hatch 114 while located on the ground 118 adjacent the storage tank 100. In some embodiments, the system may also include one or more sensors that monitor the access hatch 114 and the environment surrounding the access hatch 114. In such embodiments, the sensors may notify the tank operator on the ground 118 when it is safe to ascend the ladder 116 and approach the access hatch 114 on the roof 104.

Figure 2A:
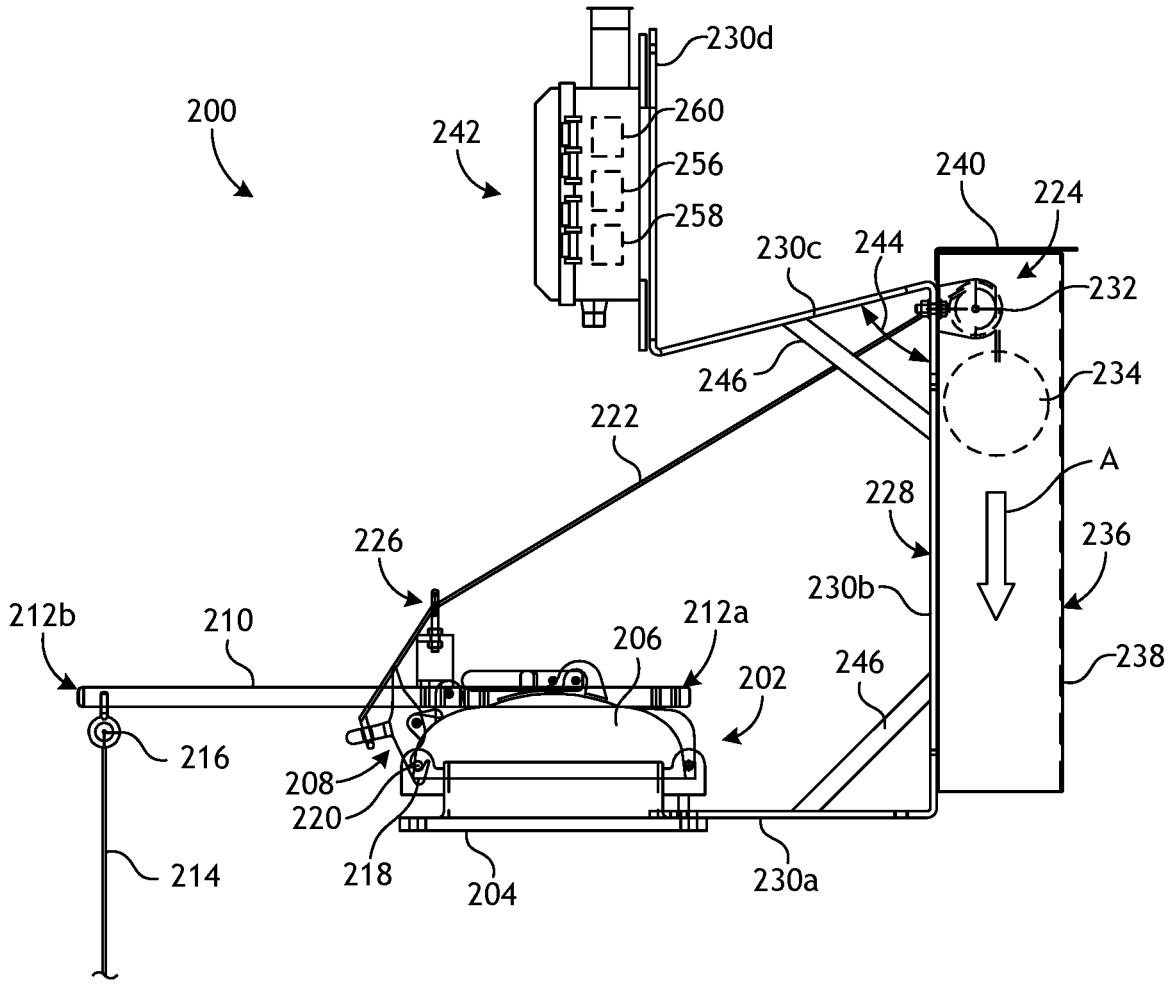
FIGS. 2A-2C are side, top and front views, respectively, of an example system for remotely operating an access hatch, according to one or more embodiments.
Figure 2B:
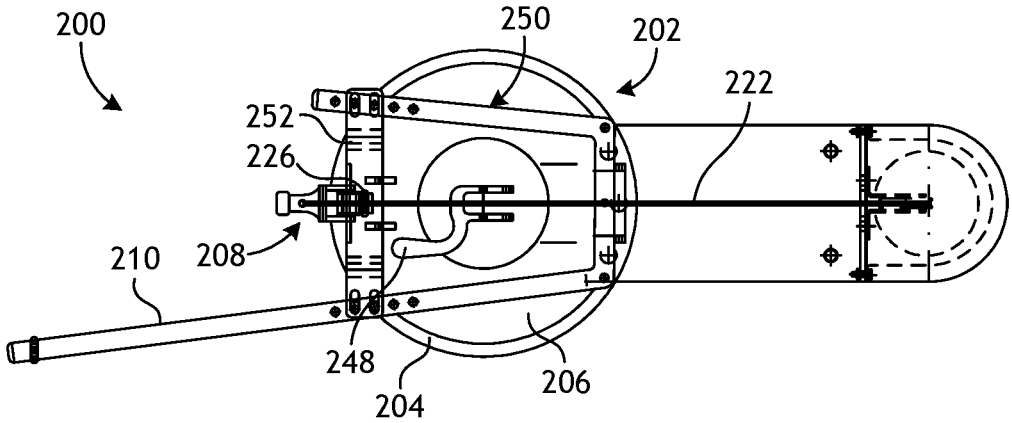
Figure 2C:
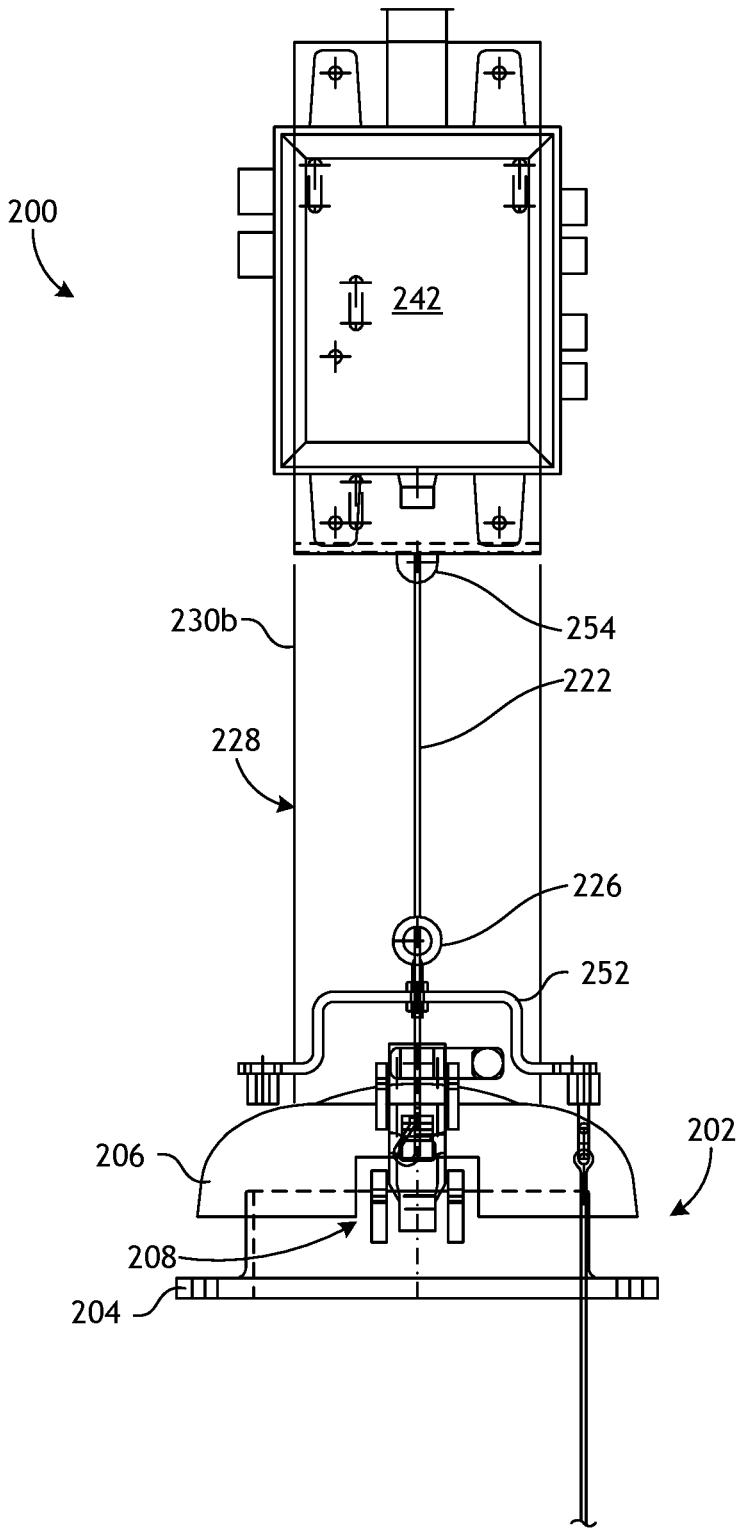

FIGS. 2A-2C are side, top, and front views, respectively, of an example system 200 for remotely operating an access hatch 202. The access hatch 202 may be the same as or similar to the access hatch 114 of FIG. 1 and, therefore, may be installed in or otherwise form part of the storage tank 100 (FIG. 1). The following discussion will describe and discuss the system 200 and the access hatch 202 as being used in conjunction with the storage tank 100. However, it should be noted that the system 200 may alternately be used in conjunction with other types of access hatches 202, and the access hatch 202 may alternately be used in conjunction with other types of storage tanks 100. Consequently, the system 200 is not limited to use with the access hatch 202 or the storage tank 100 described herein.

In some embodiments, the access hatch 202 may comprise an existing thief hatch and the system 200 can be retrofitted onto the access hatch 202. In other embodiments, however, the system 200 may form an integral part of the design and manufacture of the access hatch 202, without departing from the scope of the disclosure. As illustrated, the access hatch 202 includes a base 204, a lid 206 pivotably coupled to the base 204, and a latch 208 used to secure the lid 206 to the base 204 in a closed position.

Referring first to FIG. 2A, the system 200 includes an elongate arm 210 having a first or "proximal" end **212*a* and a second or "distal" end 212*b* opposite the proximal end 212*a*. At or near the proximal end 212*a*, the arm 210 may be operatively coupled to the lid 206 of the access hatch 202. As used herein, the term "operatively coupled" refers to an indirect or direct coupling of one member (e.g., the arm 210) to a second member (e.g., the lid 206). The arm 210 extends from the lid 206 and may have a length sufficient to extend past an outer perimeter of the storage tank 100 (FIG. 1**).

A pull cable 214 may be attached to the arm 210 at or near the distal end **212*b*. The pull cable 214 may be made of a variety of materials including, but not limited to, a metal (e.g., steel, stainless steel, aluminum, etc.), metal fibers, synthetic fibers (e.g., KEVLAR®, nylon, etc.), natural fibers, a belt, a chain, a rope, or any combination thereof. The pull cable 214 may be operatively coupled to the arm 210 at an attachment mechanism 216. In the illustrated embodiment, the attachment mechanism 216 comprises an eyebolt or the like, but could alternatively comprise any other type of attachment device or apparatus capable of coupling the pull cable 214 to the arm 210**, such as a swivel lifting ring.

The access hatch 202 is depicted in FIGS. 2A-2C in the closed position, with the lid 206 being secured to the base 204 using the latch 208. When the access hatch 202 is in the closed position, the lid 206 substantially prevents off-gases from escaping from the interior of the storage tank 100 (FIG. 1). In some embodiments, as illustrated, the latch 208 may be rotatably coupled to the lid 206, but could alternatively be rotatably coupled to the base 204, without departing from the scope of the disclosure. The latch 208 provides or otherwise defines a catch 218 matable with a pin 220 provided on the base 204. In some embodiments, the latch 208 is spring-loaded and otherwise biased toward a position where the catch 218 is able to locate and mate with the pin 220. In other embodiments, however, the latch 208 may not be spring-loaded, without departing from the scope of the disclosure.

The latch 208 is depicted in FIG. 2A in a latched position, where the catch 218 is mated with the pin 220. A weight cable 222 may be operatively coupled to the latch 208 and configured to constantly urge the latch 208 to an unlatched position, where the catch 218 is released from the pin 220. When the latch 208 is in the unlatched position, the lid 206 will be free to pivot open relative to the base 204. In the illustrated embodiment, the weight cable 222 is operatively coupled to a projection 224 extending laterally from the latch 208, but could alternatively be coupled to other portions of the latch 208, without departing from the scope of the disclosure. The weight cable 222 may be made of any of the materials mentioned herein for the pull cable 214.

The weight cable 222 extends from the latch 208 and to a pulley system 224 included in the system 200. In some embodiments, as illustrated, the weight cable 222 may extend through a guide 226 operatively coupled to the lid 206. The guide 226 may be configured to guide and control the displacement of the weight cable 222 as lid 206 is opened and the access hatch 202 is moved to the open position. In at least one embodiment, the guide 226 may comprise an eyebolt and the weight cable 222 may extend through the aperture defined by the eyebolt. In other embodiments, however, the guide 226 may comprise a swivel lifting ring or the like, without departing from the scope of the disclosure.

As illustrated, the pulley system 224 is mounted to a support frame 228 operatively coupled to the access hatch 202 and, more particularly, to the base 204. The support frame 228 includes at least a first member 230*a* and a second member 230*b* that extends from the first member 230*a*. In the illustrated embodiment, the first member 230*a* extends substantially horizontal from the base 204, and the second member 230*b* extends substantially orthogonal to the first member 230*a*. In other embodiments, however, the angular disposition of the first and second members 230*a,b* may be altered to fit particular applications. For example, it may not be necessary that the second member 230*b* extend orthogonal to the first member 230*a*.

The pulley system 224 may be mounted to the support frame 228 at or near the top of the second member 230*b*, and the weight cable 222 may extend through an aperture or cutout (not visible in FIG. 2A, see FIG. 2C) defined in the second member 230*b* to access the pulley system 224. As illustrated, the pulley system 224 includes one or more sheaves 232 (one shown), and the weight cable 222 is fed through or otherwise routed around the sheave(s) 232, and a counterweight 234 is coupled to the end of the weight cable 222. The counterweight 234 exhibits a weight sufficient to lift and otherwise force the lid 206 to pivot from the closed position to the open position. Once the latch 208 is detached from the pin 220, the gravitational pull of the counterweight 234 coupled to the end of the weight cable 222 will act (pull) on the weight cable 222 in the direction indicated by the arrow A. The weight cable 222 will correspondingly exert a force on the lid 206 at the latch 208 to open the access hatch 202.

As will be appreciated, the particular weight of the counterweight 234 may depend on the given weight of the lid 206, and may otherwise be optimized to ensure a slow but steady descent in the direction A. Moreover, the worker may simply allow the pull cable 214 to slowly retract to ensure a slow but steady descent of the counterweight 234. The counterweight 234 may be made of a variety of dense or heavy materials such as, but not limited to, a metal (e.g., iron, steel, lead, etc.), a natural material (e.g., sand, rock(s), water, etc.), concrete or cement, a plastic, a resin, or any combination thereof.

In some embodiments, the pulley system 224 and the counterweight 234 may be arranged within a weight guard 236 operatively coupled to or forming part of the support frame 228. In some embodiments, as illustrated, the weight guard 236 may include a sidewall 238 and a cover plate 240 covering the top of the sidewall 238. In at least one embodiment, the sidewall 238 may be arcuate or curved and attached to the second member 230*b* at opposing ends. In other embodiments, however, the shape of the sidewall 238 may exhibit any other geometric shapes suitable for receiving and enclosing the pulley system 224 and the counterweight 234, without departing from the scope of the disclosure.

In some embodiments, the weight guard 236 may operate as a weather cover configured to prevent snow or debris from accumulating on the pulley system 224 and the counterweight 234, which might otherwise result in malfunction of either component. In addition, the weight guard 236 may also operate as a safety feature. More specifically, if the weight cable 222 fails and the counterweight 234 drops to the roof 104 (FIG. 1), the weight guard 236 may be configured to contain the counterweight 234 so that it does not roll off the roof 104 and potentially strike and injure a tank operator (or any other person) located on the ground 118 (FIG. 1).

The system 200 may further include a monitoring system 242. In some embodiments, as illustrated, the monitoring system 242 may be mounted to the support frame 228 and generally arranged above the access hatch 202. More specifically, the support frame 228 may include a third member 230*c* that extends from the second member 230*b*, and a fourth member 230*d* that extends from the third member 230*c*, and the monitoring system 242 may be mounted to the fourth member 230*d*. In at least one embodiment, as illustrated, the third member 230*c* may extend from the second member 230*b* at an acute angle 244. In other embodiments, however, the third member 230*c* may extend perpendicular to the second member 230*b*, without departing from the scope of the disclosure. Having the third member 230*c* extend at the acute angle 244, however, may prove advantageous in allowing the monitoring system 242 to be placed closer to the access hatch 202. The acute angle 244 may comprise any angle ranging between about 45° and about 85°, but could alternatively be less than 45° or greater than 85° depending on the design of the system 200 and the configuration of the access hatch 202.

In some embodiments, as illustrated, the fourth member 230*d* may extend substantially vertical from the third member 230*c* to provide a vertical mounting location for the monitoring system 242. In other embodiments, however, the fourth member 230*d* may extend from the third member 230*c* at other suitable orientations or angles sufficient to locate the monitoring system 242 in proximity to the access hatch 202. While the monitoring system 242 is shown mounted above the access hatch 202, it is contemplated herein to mount the monitoring system 242 in any space that allows measurement of the area above and around the access hatch 202, such as laterally adjacent the access hatch 202.

The monitoring system 242 may include one or more sensors or gauges configured to monitor the state of the access hatch 202 and the area around the access hatch 202 for off-gases or any other emissions that may be toxic or harmful to humans. In some embodiments, the monitoring system 242 may also include an alert system configured to provide tank operators (workers) with visual, audible, or digital alerts regarding conditions around the access hatch 202, thus ensuring that tank operators do not approach the access hatch 202 when the environment is unsuitable for humans.

In some embodiments, the support frame 228 may further include one or more support members or "gussets" 246 installed to help support the support frame 228. In the illustrated embodiment, support members 246 are installed and extend between the first and second members 230*a,b*, and between the second and third members 230*a,b*. As will be appreciated, more or less than two support members 246 may be included in the support frame 228 and may be located at any suitable location needed to adequately buttress the support frame 228.

FIG. 2B depicts a top view of the system 200. In some embodiments, the access hatch 202 may include a handle 248 operatively coupled to the lid 206. As illustrated, the system 200 may further include a frame 250 secured to the lid 206. The frame 250 may be removably or permanently secured to the lid 206 in various ways. In some embodiments, for example, the frame 250 may be removably secured to the lid 206 using one or more mechanical fasteners such as, but not limited to, bolts, clamps, tie downs, magnets, or any combination thereof. In other embodiments, the frame 250 may be permanently secured to the lid 206 by welding, an adhesive, or any combination thereof.

In one or more embodiments, as illustrated, the frame 250 may include four interconnected members that generally form a trapezoidal shape over the lid 206 when viewed from above. One of the interconnected members may be the arm 210, which extends away from the access hatch 202. Another of the interconnected members is a cross member 252, which provides a location to mount the guide 226 for the weight cable 222. As will be appreciated, various other configurations or designs for the frame 250 may be employed, and will depend primarily on the size and shape of the lid 206. For example, the interconnected members of the frame 250 may alternatively form other geometric shapes (e.g., triangular, square, rectangular, circular, oval, ovoid, etc.), without departing from the scope of the disclosure. The frame 250 may be made of any rigid material capable of transferring a downward force on the lid 206 including, but not limited to, a metal (e.g., aluminum, iron, steel, etc.), wood, a plastic, resin, a composite material, or any combination thereof.

FIG. 2C depicts a front view of the system 200. As illustrated, the weight cable 222 extends from the latch 208 and through the guide 226 mounted to the cross member 252 above the lid 206. Moreover, the weight cable 222 penetrates the support frame 228 via an aperture 254 defined in the second member 230*b* to access the pulley system 224 (FIG. 2A). Also illustrated in FIG. 2C is the monitoring system 242 generally arranged above the access hatch 202.

Figure 3A:
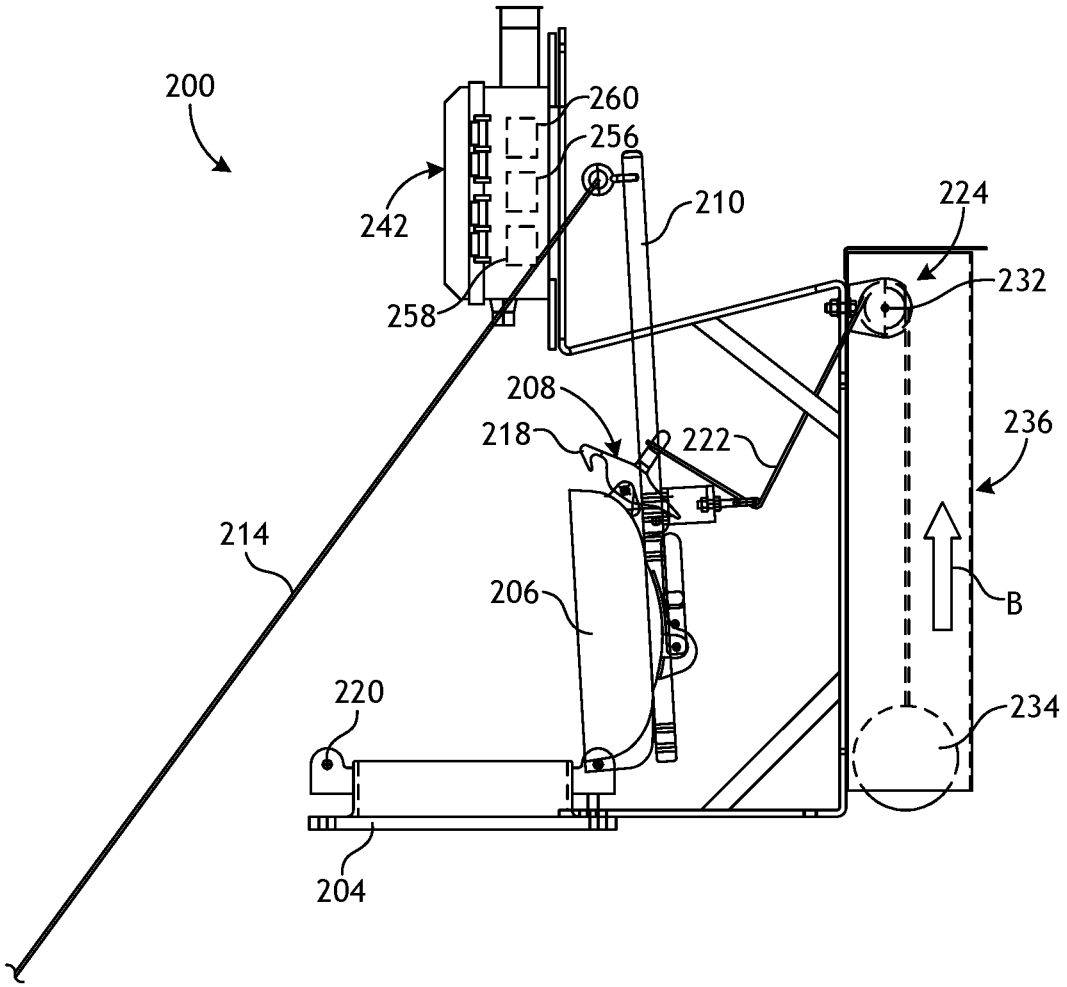
FIGS. 3A-3C are side, top and front views, respectively, of the system of FIGS. 2A-2C with the access hatch in the open position.
Figure 3B:
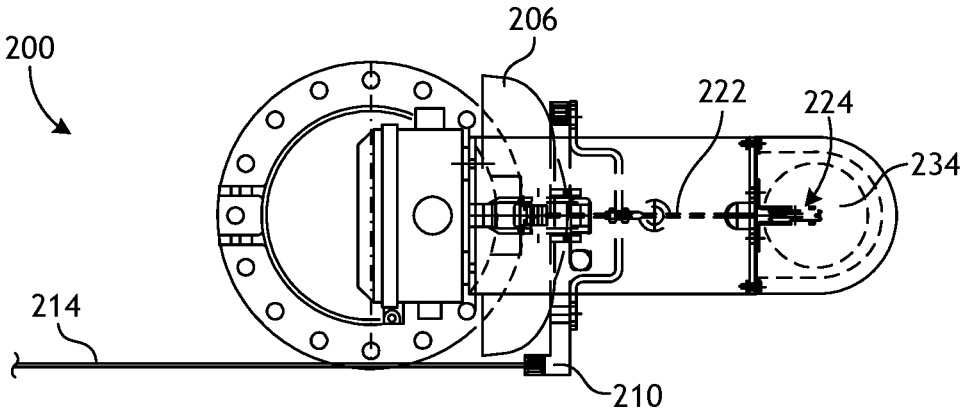
Figure 3C:
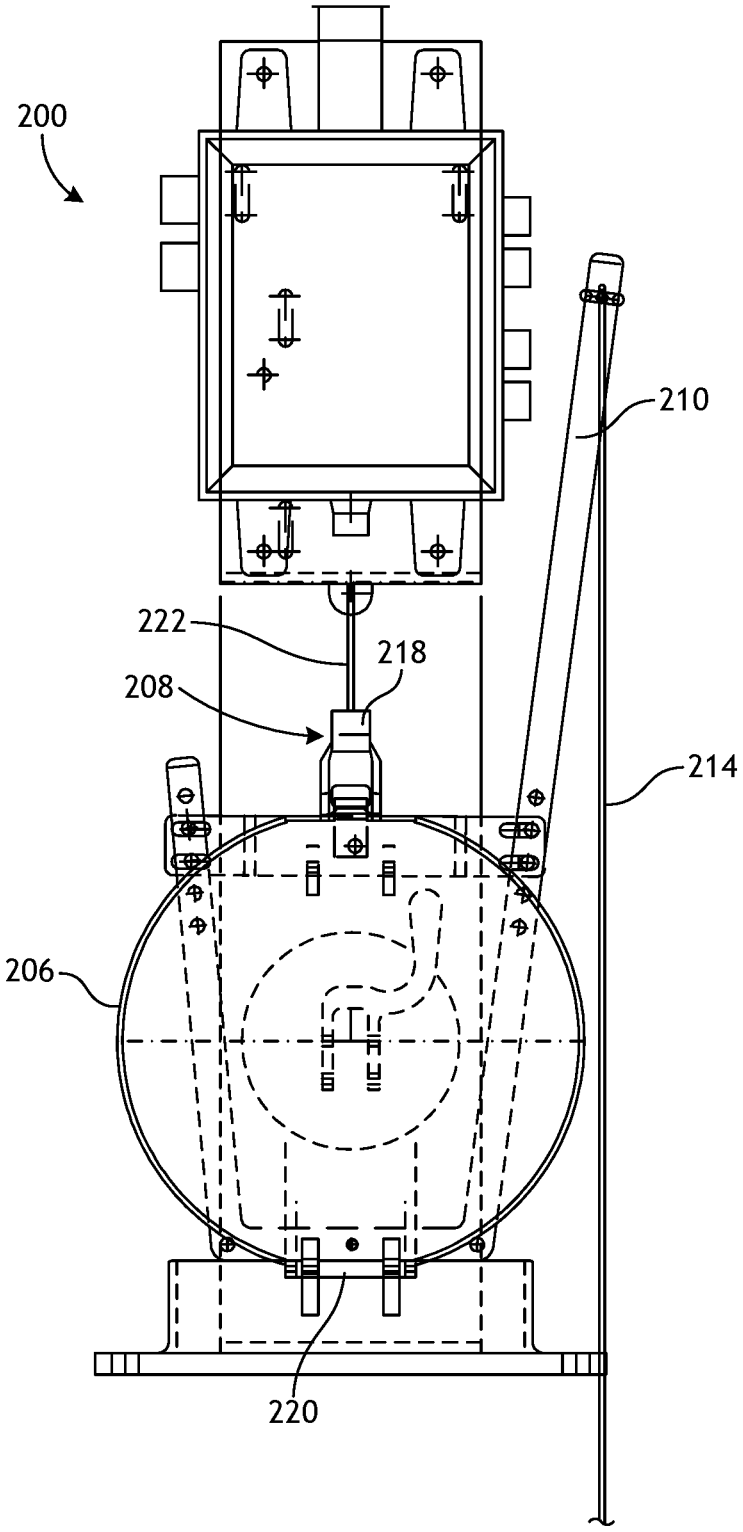

FIGS. 2A-2C depict the access hatch 202 closed or otherwise in a closed position. In contrast, FIGS. 3A-3C are side, top and front views, respectively, of the system 200 and depict the access hatch 202 open or otherwise moved to an open position. With continued reference to FIGS. 2A-2C, and additional reference to FIGS. 3A-3C, example operation of the system 200 is now provided. The system 200 is advantageous in that it allows a tank operator (worker) to open the access hatch 202 while located on the ground 118 (FIG. 1), and thus safely away from any harmful off-gas discharges that may escape from the access hatch 202 upon opening the lid 206.

To open the lid 206 of the access hatch 202, a tank operator (worker) pulls down on the pull cable 214. Since the arm 210 extends past the outer periphery of the storage tank 100 (FIG. 1), the pull cable 214 will extend down toward the ground 118 (FIG. 1) to be accessible by the tank operator located on the ground 118. Pulling down on the pull cable 214 places a downward load on the arm 210, and the arm 210 transmits the downward load to the frame 250 (FIG. 2B). The frame 250 distributes the downward load over the lid 206, which forces the lid 206 downward and simultaneously lowers the latch 208 to allow the catch 218 to disengage from the pin 220. As the latch 208 is lowered, the constant force provided on the latch 208 by the weight cable 222 causes the latch 208 to pivot to the unlatched position where the catch 218 is released from the pin 220. With the latch 208 disengaged from the pin 220, the counterweight 234 is then free to descend in the direction A (FIG. 2A). As the counterweight 234 descends, the weight cable 222 feeds through the sheave(s) 232 of the pulley system 224 and simultaneously pulls on the lid 206 at the latch 208, which is correspondingly urged to pivot toward the open position.

In FIG. 3A, the counterweight 234 is depicted as having descended within the weight cover 236, which pulls the weight cable 222 through the sheave(s) 232 and thereby pivots the lid 206 away from the base 204 and to the open position. As the lid 206 pivots to the open position, the arm 210 is correspondingly raised and pulls a portion of the pull cable 214 upward, but the pull cable 214 has a length sufficient that it is still accessible by the tank operator (worker) at the ground 118 (FIG. 1) when the access hatch 202 is in the open position.

To return the access hatch 202 to the closed position, the tank operator can manually close the lid 206 while located on the roof 104 (FIG. 1). As the lid 206 pivots back to the closed position, the counterweight 234 is correspondingly raised within the weight cover 236 as connected to the weight cable 222, as indicated by the arrow B in FIG. 3A. Once the latch 208 reaches the pin 220, the worker is able to engage the catch 218 on the pin 220 and thereby secure the latch 208 in place, and thus secure the access hatch 202 in the closed position. Alternatively, the access hatch 202 can be returned to the closed position by the tank operator located on the ground 118 (FIG. 1). To accomplish this, the tank operator again pulls on the pull cable 214, which places a load on the lid 206 through the interconnected arm 210. As the pull cable 214 is retracted, the lid 206 pivots back to the closed position, and the counterweight 234 is correspondingly raised within the weight cover 236 as connected to the weight cable 222, as indicated by the arrow B. Once the lid 206 pivots back down, the flow of escaping off-gases will be prevented, which allows the tank operator to approach the access hatch 202 and safely manually re-latch and secure the lid 206.

In addition to being able to remotely open the access hatch 202 from the ground 118 (FIG. 1), the system 200 also includes the monitoring system 242 arranged adjacent the access hatch 202. In some embodiments, as indicated above, the monitoring system 242 may include one or more sensors or gauges configured to monitor the state of the access hatch 202. For example, the monitoring system 242 may include one or more proximity sensors 256 (FIGS. 2A and 3A) capable of detecting the general position of the lid 206 and verifying if the lid 206 is securely attached to the base with the latch 208. In such embodiments, the proximity sensors 256 may be able to detect if the catch 218 has located and engaged the pin 220, or if the lid 206 is properly situated in a predetermined configuration relative to the base 204, thus indicative of the lid 206 being secured to the base 204.

In addition thereto, the monitoring system 242 may also include one or more sensors or gauges configured to monitor the area around the access hatch 202 for off-gases or any other emissions that may be toxic or harmful to humans. In such embodiments, the monitoring system 242 may include one or more environment sensors 258 (FIGS. 2A and 3A) configured to monitor the environment (air) around the access hatch 202. The environment sensor(s) 258 may operate continuously, may take measurements periodically based on a predetermined sampling interval, or may be manually operated as needed.

The environment sensor(s) 258 may be able to detect chemical compounds including, but not limited to, off-gases of hydrogen sulfide, pentane, hexane, benzene, xylene, methane, ethane, propane, butane, toluene, oxygen, heptanes, hexanes, and combinations thereof. The environment sensor(s) 258 may utilize any detection method for detecting these compounds, for example, non-dispersive infrared (NDIR), photo ionization detectors (PIDs), differential absorption infrared laser (DIAL), differential optical absorption spectrometry (DOAS), Fourier-transform infrared (FT-IR), back scatter absorption gas imaging (BAGI), electro-environment sensors, metal oxide semiconductor sensors, thermal sensors, or any combination thereof. In some embodiments, the environment sensor(s) 258 may include a lower explosive limit (LEL) sensor.

Accordingly, the environment sensor(s) 258 may prove advantageous in determining if a large concentration of harmful off-gases and vapors is released when the access hatch 202 is opened. Moreover, the environment sensor(s) 258 may also operate to detect any leaks in the access hatch 202, which may be caused by wear, corrosion, or improper securing of the access hatch 202 after sampling.

In some embodiments, the monitoring system 242 may also include an alert system 260 (FIGS. 2A and 3A) configured to provide tank operators (workers) with one or more alarms or alerts regarding conditions around the access hatch 202, thus ensuring that tank operators do not approach the access hatch 202 when the environment is unsuitable for humans. Any alarms or alerts (referred to collectively herein as "alerts") provided through the alert system 260 may be perceivable or otherwise detectable by a tank operator located on the ground 118 (FIG. 1). In some embodiments, for example, the alert may comprise a visual alert, such as flashing or colored lights perceivable by the worker. In other embodiments, or in addition thereto, the alert may comprise an audible alert, such as a warning siren or an audible message conveyed to and otherwise hearable by the worker. In yet other embodiments, or in addition thereto, the alert may comprise a digital alert sent to the worker via email, text, etc.

The alert system 260 may be binary (i.e., the alerts are either "on" or "off") or non-binary (e.g., the alert state may change). In embodiments where the alert system 260 is binary, for example, the alert system 260 may be programmed to trigger an alert based on meeting different situational criteria or sets of criteria including, but not limited to, whether the lid 206 is open or closed, time since the lid 206 was last opened or closed, concentration of specific off-gases, concentration of total off-gases, oxygen levels, air temperature, wind direction, or any combination thereof. In such embodiments, the alert system 260 may be programmed to indicate if the VOC concentration is above, and/or if the oxygen level is below, a predetermined safety threshold limit where a worker may experience unconsciousness if the air containing said VOC concentration is inhaled.

In contrast, in embodiments where the alert system 260 is non-binary, the state of the alerts may be based on the same criteria listed above for binary systems, but change when criteria conditions change. For example, the auditory nature of the alert may change (e.g., volume, tone, pulsing, etc.), the visual nature may change (e.g., color, flashing rate, brightness, etc.), or a combination of both aspects may change. In such embodiments, alert changes may be triggered when VOC levels are high and then change in some detectable manner when the VOC concentration is at a lower and safe level.

In other embodiments, the monitoring system 242 may be programmed to trigger an alert if the off-gas concentration is above a leak threshold that indicates unchecked release of off-gases into the atmosphere. The alert trigger may further depend on whether the lid 206 is closed or open. This programming may be useful to signal that a leak may be present in the access hatch 202. In yet other embodiments, the monitoring system 242 may be programmed with a leak threshold and trigger an alert if the time since the lid 206 was opened but not yet closed (or latched) exceeds a predetermined time period and the off-gas concentration exceeds a certain threshold. This programming may be useful to signal that the lid 206 was left open or was not secured fully.

Accordingly, the monitoring system 242 may advantageously indicate to a worker when it is safe to approach the access hatch 202. Using the system 200 for remotely opening the access hatch 202 in conjunction with the monitoring system 242 can improve worker safety by allowing the worker to open the access hatch 202 without being in the vicinity of potentially escaping toxic gases, and warning the worker if the environment near the access hatch 202 has unsafe levels of such gases. When the access hatch 202 is opened by the worker located on the ground 118 (FIG. 1), the environment sensor(s) 258 in the monitoring system 242 placed near the access hatch 202 will detect if a dangerous level of toxic gases has been released.

Embodiments disclosed herein include:

A. A storage tank for containing one or more fluids that includes a floor, a roof, a sidewall extending between the floor and the roof, an access hatch provided on the roof and having a base, a lid pivotably coupled to the base, and a latch configured to secure the lid to the base in a closed position, and a system for remotely opening the access hatch. The system including an elongate arm having a proximal end operatively coupled to the lid and a distal end extending past an outer perimeter of the storage tank, and a pull cable attached to the arm at the distal end and extending toward a ground adjacent the storage tank, wherein pulling on the pull cable from the ground releases the latch allows the lid to pivot from the closed position to an open position.

B. A system for remotely opening an access hatch of storage tank, including an elongate arm having a proximal end configured to be operatively coupled to a lid of the access hatch and a distal end extendable past an outer perimeter of the storage tank, and a pull cable attached to the arm at the distal end and being extendable toward a ground adjacent the storage tank, wherein pulling on the pull cable releases a latch that secures the lid to a base of the access hatch and allows the lid to pivot from a closed position to an open position.

C. A method of opening an access hatch of a storage tank, the method including manually pulling on a pull cable attached to an elongate arm operatively coupled to a lid of the access hatch and thereby placing a downward load on the arm, the arm extending past an outer perimeter of the storage tank, transmitting the downward load on the arm to the lid and thereby disengaging a latch of the access hatch, the latch being coupled to a first end of a weight cable that extends to a pulley system, allowing a counterweight coupled to a second end of the weight cable to descend under gravitational forces and thereby pulling on the weight cable coupled to the latch, and pivoting the lid toward an open position as the counterweight descends and the weight cable pulls on the lid at the latch.

Each of embodiments A, B, and C may have one or more of the following additional elements in any combination: Element 1: wherein the system further includes a support frame operatively coupled to the access hatch, a pulley system mounted to the support frame, a weight cable having a first end operatively coupled to the latch and extending to the pulley system, and a counterweight coupled to a second end of the weight cable, wherein the counterweight causes the weight cable to constantly urge the latch to an unlatched position, and wherein, once the latch becomes unlatched, gravitational pull of the counterweight acts on the weight cable to pivot the lid to the open position. Element 2: wherein the system further includes a weight guard coupled to the support frame, the pulley system and the counterweight being arranged within the weight guard. Element 3: wherein the system further includes a monitoring system mounted to the support frame adjacent the access hatch and including one or more sensors. Element 4: wherein the monitoring system further includes an alert system configured to provide alerts regarding the access hatch and conditions of an environment around the access hatch based on measurements obtained by the one or more sensors.

Element 5: further comprising a support frame configured to be operatively coupled to the access hatch, a pulley system mounted to the support frame, a weight cable having a first end configured to be operatively coupled to the latch and extending to the pulley system, and a counterweight coupled to a second end of the weight cable, wherein the counterweight causes the weight cable to constantly urge the latch to an unlatched position, and wherein, once the latch becomes unlatched, gravitational pull of the counterweight acts on the weight cable to pivot the lid to the open position. Element 6: further comprising a weight guard coupled to the support frame, the pulley system and the counterweight being arranged within the weight guard. Element 7: further comprising a monitoring system mounted to the support frame adjacent the access hatch and including one or more sensors. Element 8: wherein the one or more sensors include one or more proximity sensors configured to monitor a state of the lid between the closed and open positions. Element 9: wherein the one or more sensors include one or more environment sensors configured to monitor an environment around the access hatch and detect one or more off-gases. Element 10: wherein the one or more sensors include a lower explosive limit sensor. Element 11: wherein the monitoring system further includes an alert system configured to provide alerts regarding the access hatch and conditions of an environment around the access hatch. Element 12: wherein the alerts are selected from the group consisting of a visual alert, an audible alert, a digital alert, and any combination thereof. Element 13: wherein the arm forms part of a frame securable to the lid, the system further comprising a guide mounted to a cross member of the frame, wherein the weight cable extends through the guide.

Element 14: further comprising monitoring the access hatch and an environment surrounding the access hatch with a monitoring system mounted to a support frame operatively coupled to the access hatch. Element 15: further comprising detecting a chemical compound in the surrounding environment with one or more sensors included in the monitoring system. Element 16: wherein the monitoring system includes an alert system, the method further comprising providing an alert to a tank operator regarding the surrounding environment with the alert system, the alerts being selected from the group consisting of a visual alert, an audible alert, a digital alert, and any combination thereof. Element 17: wherein providing the alert to the tank operator comprises sending the alert to the tank operator when a concentration of a chemical compound surpasses a predetermined limit. Element 18: further comprising manually pulling on the pull cable from a location on a ground adjacent the storage tank, placing a load on the lid through the interconnected arm as the pull cable is pulled, and pivoting the lid back to a closed position as the pull cable is pulled from the ground.

By way of non-limiting example, exemplary combinations applicable to A, B, and C include: Element 1 with Element 2; Element 1 with Element 3; Element 3 with Element 4; Element 5 with Element 6; Element 6 with Element 7; Element 7 with Element 8; Element 8 with Element 9; Element 8 with Element 10; Element 7 with Element 11; Element 11 with Element 12; Element 14 with Element 15; Element 14 with Element 16; and Element 16 with Element 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A storage tank for containing one or more fluids, comprising:

a floor;

a roof;

a sidewall extending between the floor and the roof and defining an outer perimeter of the storage tank;

an access hatch provided on the roof and having a base, a lid pivotably coupled to the base, and a latch configured to secure the lid to the base in a closed position; and a system for remotely opening the access hatch and including:

an elongate arm having a proximal end operatively coupled to the lid and a distal end extending past the outer perimeter of the storage tank;

a pull cable attached to the arm at the distal end and extending toward a ground adjacent the storage tank;

a support frame operatively coupled to the access hatch, and a pulley system mounted to the support frame;

a weight cable having a first end operatively coupled to the latch and extending to the pulley system; and a counterweight coupled to a second end of the weight cable to constantly urge the latch to an unlatched position, wherein pulling on the pull cable from the ground releases the latch and allows the lid to pivot from the closed position to an open position, and wherein once the latch becomes unlatched, the counterweight acts on the weight cable to pivot the lid to the open position.

2. The storage tank of claim 1, wherein the system further includes a weight guard coupled to the support frame, the pulley system and the counterweight being arranged within the weight guard.

3. The storage tank of claim 1, wherein the system further includes a monitoring system mounted to the support frame adjacent the access hatch and including one or more sensors.

4. The storage tank of claim 3, wherein the monitoring system further includes an alert system configured to provide alerts regarding the access hatch and conditions of an environment around the access hatch based on measurements obtained by the one or more sensors.

5. A system for remotely opening an access hatch of a storage tank, comprising:

an elongate arm having a proximal end configured to be operatively coupled to a lid of the access hatch and a distal end extendable past an outer perimeter of the storage tank;

a pull cable attached to the arm at the distal end and being extendable toward a ground adjacent the storage tank;

a support frame configured to be operatively coupled to the access hatch;

a pulley system mounted to the support frame;

a weight cable having a first end configured to be operatively coupled to the latch and extending to the pulley system; and a counterweight coupled to a second end of the weight cable to constantly urge the latch to an unlatched position, wherein pulling on the pull cable releases a latch that secures the lid to a base of the access hatch and allows the lid to pivot from a closed position to an open position, and wherein once the latch becomes unlatched, gravitational pull of the counterweight acts on the weight cable to pivot the lid to the open position.

6. The system of claim 5, further comprising a monitoring system mounted to the support frame adjacent the access hatch and including one or more sensors.

7. The system of claim 6, wherein the one or more sensors include one or more proximity sensors that monitor a state of the lid between the closed and open positions.

8. The system of claim 6, wherein the one or more sensors include one or more environment sensors that monitor an environment around the access hatch to detect one or more off-gases.

9. The system of claim 6, wherein the one or more sensors include a lower explosive limit sensor.

10. The system of claim 6, wherein the monitoring system further includes an alert system configured to provide alerts regarding the access hatch and conditions of an environment around the access hatch.

11. The system of claim 10, wherein the alerts are selected from the group consisting of a visual alert, an audible alert, a digital alert, and any combination thereof.

12. The system of claim 5, wherein the arm forms part of a frame securable to the lid, the system further comprising a guide mounted to a cross member of the frame, wherein the weight cable extends through the guide.

13. A method of opening an access hatch of a storage tank, comprising:

manually pulling on a pull cable attached to a distal end of an elongate arm operatively coupled to a lid of the access hatch and thereby placing a downward load on the arm, the arm extending past an outer perimeter of the storage tank;

transmitting the downward load on the arm to the lid and thereby disengaging a latch of the access hatch, the latch being coupled to a first end of a weight cable that extends to a pulley system;

allowing a counterweight coupled to a second end of the weight cable to descend under gravitational forces and thereby pulling on the weight cable coupled to the latch; and pivoting the lid toward an open position as the counterweight descends and the weight cable pulls on the lid at the latch.

14. The method of claim 13, further comprising monitoring the access hatch and an environment surrounding the access hatch with a monitoring system mounted to a support frame operatively coupled to the access hatch.

15. The method of claim 14, further comprising detecting a chemical compound in the surrounding environment with one or more sensors included in the monitoring system.

16. The method of claim 14, wherein the monitoring system includes an alert system, the method further comprising providing an alert to a tank operator regarding the surrounding environment with the alert system, the alerts being selected from the group consisting of a visual alert, an audible alert, a digital alert, and any combination thereof.

17. The method of claim 16, wherein providing the alert to the tank operator comprises sending the alert to the tank operator when a concentration of a chemical compound surpasses a predetermined limit.

18. The method of claim 13, further comprising:

manually pulling on the pull cable from a location on a ground adjacent the storage tank;

placing a load on the lid through the arm as the pull cable is pulled; and pivoting the lid back to a closed position as the pull cable is pulled from the ground.

* * * * *